United States Patent [19]

Sodeno

[11] Patent Number: 4,795,072

[45] Date of Patent: Jan. 3, 1989

[54] BUTTON ORIENTING AND PLACING APPARATUS

[75] Inventor: Toshiaki Sodeno, Toyama, Japan

[73] Assignee: Yoshida Kogyo K. K., Tokyo, Japan

[21] Appl. No.: 923,101

[22] Filed: Oct. 24, 1986

[30] Foreign Application Priority Data

Oct. 26, 1985 [JP] Japan ..... 60-164846[U]

[51] Int. Cl.[4] ..... A41H 37/10

[52] U.S. Cl. ..... 227/18; 227/119

[58] Field of Search ..... 227/117–120, 227/155, 18

[56] References Cited

U.S. PATENT DOCUMENTS

| | | | |
|---|---|---|---|
| 3,367,550 | 2/1968 | Jezierski | 227/117 |
| 3,964,661 | 6/1976 | Schmidt et al. | 227/119 |
| 4,019,666 | 4/1977 | Foults | 227/119 |
| 4,354,588 | 10/1982 | Wolfertz | 227/119 |
| 4,427,146 | 1/1984 | Seki | 227/119 |
| 4,569,470 | 2/1986 | Tanaka | 227/119 |
| 4,592,501 | 6/1986 | Sodeno et al. | 227/119 |

FOREIGN PATENT DOCUMENTS 52-13943 2/1977 Japan .

*Primary Examiner*—Frank T. Yost
*Assistant Examiner*—James L. Wolfe
*Attorney, Agent, or Firm*—Hill, Van Santen, Steadman & Simpson

[57] ABSTRACT

A button orienting and placing apparatus comprises a guide table defining a substantially horizontal first guide channel, and a chute defining a slanting second guide channel communicating at its lower end with one end portion of the first guide channel remotely from a die. Each of the first and second guide channels is composed of a button-head guide passageway for receiving a head of the button, and a claw guide passageway for receiving a pair of claws of the button. The claw guide passageway of the first guide channel has a arcuate lower end portion curved toward the die.

1 Claim, 5 Drawing Sheets

BUTTON ORIENTING AND PLACING APPARATUS

BACKGROUND OF THE INVENTION

1. Field of the Invention

The present invention relates to a machine for attaching fasteners, such as clinch-type and snap-type buttons each having a pair of claws, to a garment, and more particularly to an apparatus for placing such buttons one at a time on a die in a predetermined direction or orientation.

2. Description of the Prior Art

Machines for attaching fasteners, such as clinch-type and snap-type buttons, to a garment are known in which a button and its mating fastener part are delivered at a time from their respective chutes to a die and a punch, respectively, and are then clinched or joined together by the punch and die with the garment placed therebetween. If the button bears on its front side a design, mark, symbol or emblem requiring a specified orientation or direction in which the button is to be placed on a garment, the button must be oriented in such direction before the button arrives at the die.

Japanese Patent Laid-Open Publication (Kokai) No. 52-13943 discloses an apparatus for orienting buttons, each having a pair of claws projecting from a rear side of a disk-like button head and spaced from each other radially of the disk-like head. The prior apparatus includes a pair of guide blocks mounted in a travelling path of the buttons by means of compression springs and having a pair of confronting wave-shaped edges defining a labyrinth passageway of a varying width decreasing progressively toward the die. During the travel of the individual button through the labyrinth passageway, the button turns or rolls, until it is oriented in a predetermined orientation or direction, as the confronting wave-shaped edges slidingly and resiliently engage the two claws of the button. However, this known apparatus requires a relatively large number of structural members and is hence complex in construction and expensive to manufacture.

SUMMARY OF THE INVENTION

It is therefore an object of the present invention to provide an apparatus for placing buttons one at a time onto a die in a predetermined orientation or direction, which apparatus is simple in construction and can be attached to a button attaching machine with ease.

According to the present invention, a button orienting and placing apparatus comprises a guide table defining a substantially horizontal first guide channel, and a chute defining a slanting second guide channel communicating at its lower end with one end portion of the first guide channel remotely from a die. Each of the first and second guide channels is composed of a button-head guide passageway for receiving a head of the individual button, and a claw guide passageway for receiving a pair of claws of the button. The claw guide passageway of the second guide channel has an arcuate lower end portion curved toward the die.

Many other advantages, features and additional objects of the present invention will become manifest to those versed in the art upon making reference to the detailed description and the accompanying drawings in which an embodiment incorporating the principles of the present invention is shown by way of illustrative example.

DETAILED DESCRIPTION

Figure 1:
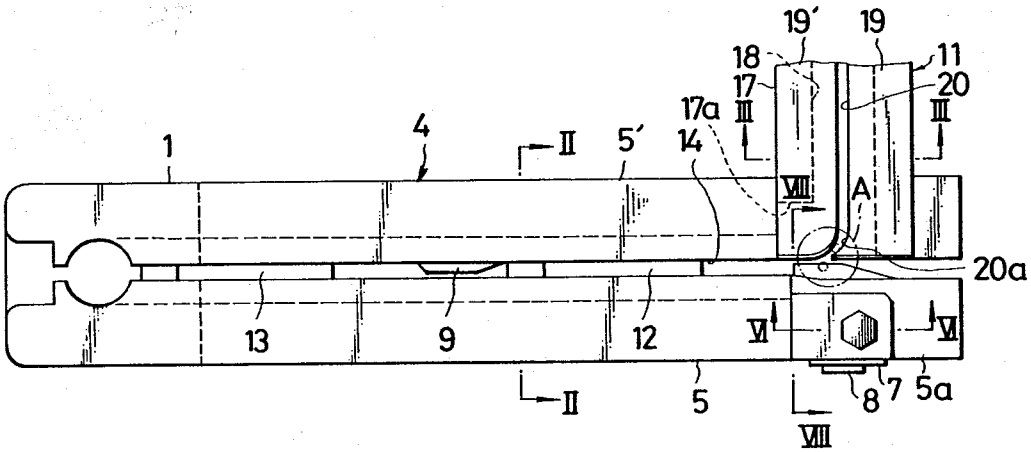
FIG. 1 is a plan view of a button orienting and placing apparatus according to the present invention, with a chute fragmentarily shown.
Figure 4:
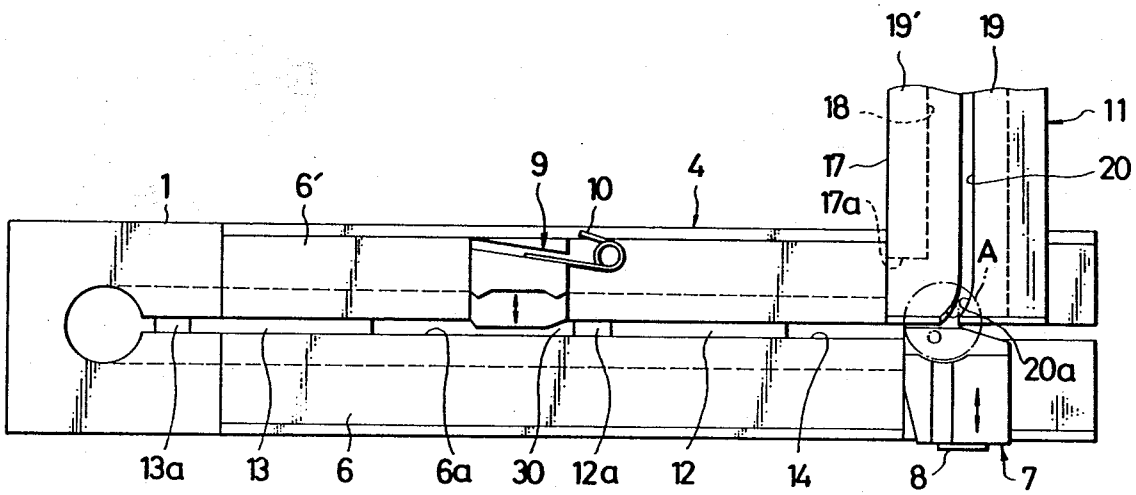
FIG. 4 is a view similar to FIG. 1, showing the guide table with a pair of cover plates omitted.

As shown in FIGS. 1 and 4, a button orienting and placing apparatus generally comprises an elongate guide table 4 defining a substantially horizontal first guide channel for guiding buttons A one at a time onto a die 1 disposed contiguous to one end of the guide table 4, a chute 11 defining a slanting second guide channel for receiving from a reservoir (not shown) the buttons A in a row and for discharging out of the chute 11 the buttons A one at a time into the first guide channel, and a pusher mechanism (described below) mounted within the guide table 4 for pushing the button A in the first guide channel onto the die 1.

Figure 2:
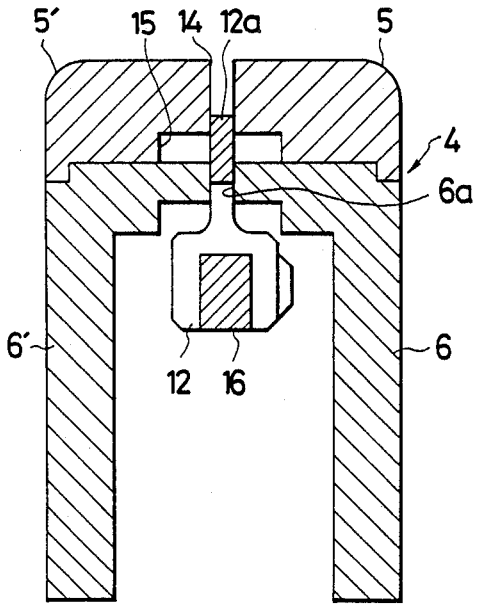
FIG. 2 is an enlarged cross-sectional view taken along line II—II of FIG. 1.
Figure 3:
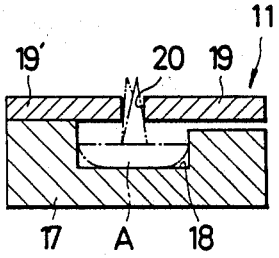
FIG. 3 is an enlarged cross-sectional view taken along line III—III of FIG. 1.

The guide table 4, as better shown in FIG. 2, includes a pair of support bases 6, 6' of substantially inverted L-shaped cross section, and a pair of cover plates 5, 5' mounted on the support bases 6, 6', respectively. The two cover plates 5, 5' have their confronting inner edges spaced parallelly from each other by a predetermined distance, and each cover plate 5, 5' has a cutout in and along a lower corner of the inner edge. The confronting inner edges of the two cover plates 5, 5' define a claw guide passageway 14 for frictionally guiding therethrough a pair of claws of the individual button A such that the latter does not turn or roll, while the confronting cutouts of the two cover plates 5, 5' and the two support bases 6, 6' define a button-head guide passageway 15 for guiding therethrough a disk-like head of the individual button A. Thus, the first guide channel is composed of the claw guide passageway 14 and the button-head guide passageway 15.

The two support bases 6, 6' are laterally spaced so as to define between their confronting upper edges a longitudinal space 6a through which first and second pushers 12, 13 of the pusher mechanism is projectable into and retractable from the button-head guide passageway 15. The first and second pushers 12, 13 are also reciprocable along the longitudinal space 6a.

Figure 6:
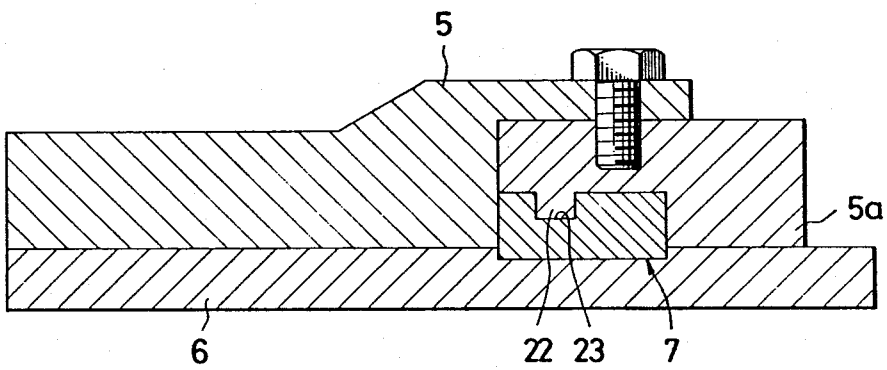
FIG. 6 is an enlarged cross-sectional view taken along line VI—VI of FIG. 1, showing a chute-side end portion of the guide table.
Figure 7:
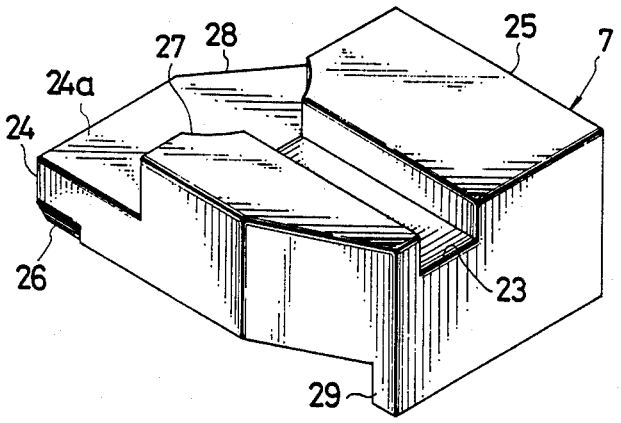
FIG. 7 is an enlarged perspective view of a first stop shown in FIGS. 1, 4 and 6.
Figure 8:
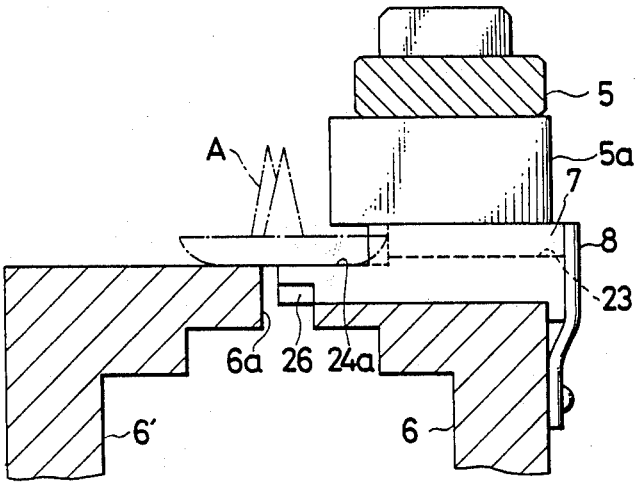
FIG. 8 is an enlarged cross-sectional view taken along line VIII—VIII of FIG. 1, showing a button having been oriented in a predetermined direction.

As shown in FIGS. 1 and 6, one of the cover plates 5 has a reduced width at its one end portion adjacent to the chute 11, and an auxiliary cover plate 5a is fixedly mounted between the corresponding support base 6 and the cover plate 5. A first stop 7 is mounted between the support base 6 and the auxiliary cover plate 5a and is reciprocable toward and away from the chute 11, for a purpose described below. A second stop 9 is mounted on the other cover plate 5' substantially centrally between the chute 11 and the die 1 and is reciprocable toward and away from the opposite cover plate 5, for a purpose described below.

The first stop 7 is slidably received between the auxiliary cover plate 5a and the corresponding support base 6 and is movable in the directions of arrows in FIG. 4 for receiving the button A from the chute 11 to temporarily prevent the button A from entering the first guide channel in the guide table 4. The first stop 7 is normally urged by a leaf spring 8 toward the other support base 6' so as to retractably project into the button-head guide passageway 15.

As shown in FIGS. 4, 6, 7 and 8, the first stop 7 is in the form of a double-stage block including a small-thickness portion 24 and a large thickness portion 25. The small-thickness portion 24 has a horizontal top surface 24a which is flush with the top surface of the support base 6 as the first stop 7 is received in a recess (not numbered) in the top surface of the support base 6, while the large-thickness portion 25 has a groove 23. The small-thickness portion 24 projects into the longitudinal space 6a as the first stop 7 is mounted on the support base 6. The small-thickness portion 24 has also a slanting lower cam surface 26 at the die-side edge of is bottom. The first stop 7 has at a step portion between the small-thickness and large-thickness portions 24, 25 a concave surface 27 corresponding to the peripheral surface of the head of the button A. At the other side edge remote from the die 1, the small-thickness portion 24 has a side cam surface 28. The large-thickness portion 25 has on its bottom a downwardly directed projection 29 engageable with the side surface of the support base 6 so as to restrict the first stop 7 from entering the longitudinal space 6a under the bias of the leaf spring 8.

Figure 5:
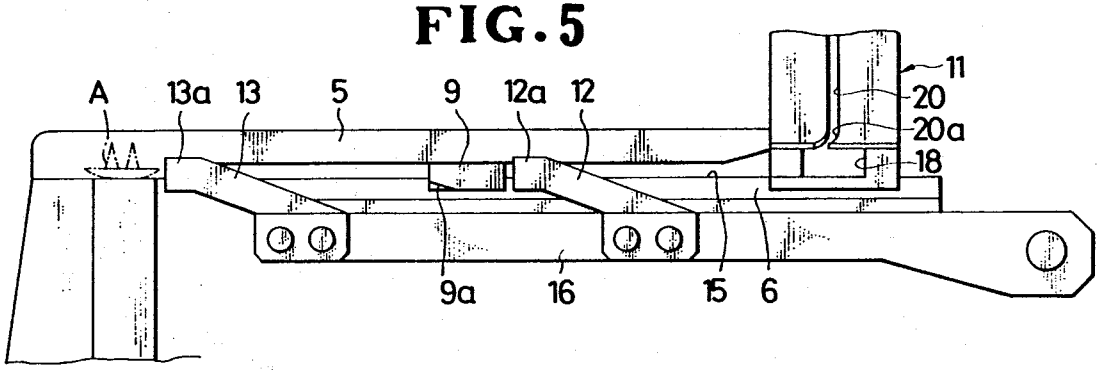
FIG. 5 is a front elevational view, with parts broken away, of the apparatus, showing first and second pushers.

The second stop 9 is slidably received in a recess (not shown) disposed substantially centrally of the other support base 6' and is movable in the directions of arrows in FIG. 4 for temporarily stopping the button A again which is moved forwardly in the first guide channel of the guide table 4 after having been released from the first stop 7. The second stop 9 is normally urged by a spring 10 toward the support base 6 so as to retractably project into the longitudinal space 6a. As shown in FIG. 5, each of the first and second pushers 12, 13 is adapted to push the head of the button A by its upper or front end 12a, 13a. The first pusher 12 pushes the button A from the first stop 7 to the second stop 9, and then the second pusher 13 pushes the button A from the second stop 9 to the die 1. The first and second pushers 12, 13 are mounted on a support bar 16 disposed below the first guide channel in the guide table 4, as shown in FIGS. 2 and 5.

The support bar 16 is pivotally connected at one end to a non-illustrated drive via a non-illustrated toggle joint at a position downstream of a joint between the guide table 4 and the chute 11. Each of the first and second pushers 12, 13 extends obliquely upwardly from the support bar 16 through the longitudinal space 6a into the button-head and claw guide passageways 15, 14. When the support bar 16 is moved to its foremost position, the first and second pushers 12, 13 are disposed immediately upstream of the second stop 9 and the die 1, respectively, as shown in FIG. 5. When the support bar 16 is fully retracted, the first and second pushers 12, 13 are disposed immediately upstream of the first stop 7 and the second stop 9, respectively.

As shown in FIGS. 1, 3, 4 and 5, the chute 11 includes an elongate chute base 17 of a generally C-shaped cross section, and a pair of covering plates 19, 19' covering the open side of the chute base 17. The two covering plates 19, 19' are laterally spaced in parallel from each other b a predetermined distance to define between their confronting inner edges a claw guide passageway 20 for frictionally guiding therethrough the two claws of the button A so as to prevent the latter from turning or rotating with respect to the claw guide passageway 20. The two covering plates 19 and 19' and the chute base 17 jointly define a button-head guide passageway 18 for guiding therethrough the head of the button A.

Most importantly, tee claw guide passageway 20 of the chute 11 has an arcuate lower end portion 20a curved progressively toward the die 1 and opening at its lower end to the claw guide passageway 14 of the guide table 4. Thus, the two claw guide passageways 20, 14 communicate with each other, while the two button-head guide passageways 18, 15 communicate with each other.

The die-side wall of the chute base 17 has a cut-out 17a in its lower end portion so that the claws of the button A are smoothly guided along the arcuate lower end portion 20a of the claw guide passageway 20.

As shown in FIGS. 1 and 4, a tangential line at the lower end of the arcuate lower end portion 20a of the claw guide passageway 20 is disposed preferably at an angle of 45° to 65° with respect to the claw guide passageway 14 of the guide table 4.

As shown in FIG. 6, the auxiliary cover plate 5a has on its bottom side a ridge 22 of a rectangular cross section which is slidably received in the groove 23 of the first stop 7 so that the first stop 7 can be moved so as to project into and retract from the longitudinal space 6a.

In operation, as the button A having been supplied from the non-illustrated reservoir is guided through the chute 11 toward the guide table 4, the head of the button A slides downwardly along the button-head guide passageway 18, and the two claws of the button A slide downwardly along the claw guide passageway 20 to reach the arcuate lower end portion 20a. While the two claws of the button A slide along the arcuate lower end portion 20a, the button A is turned through an angle equal to the central angle subtended by the arcuate lower end portion 20a. The button A then falls on the top horizontal surface 24a of the first stop 7 and is temporarily stopped as the edge of the head of the button A is received in the concave surface 27. As a result, the button A has been oriented in a predetermined direction.

Then, when the first pusher 12 (which is disposed immediately upstream of the first stop 7 is moved toward the die 1, the first stop 7 is retracted from the longitudinal space 6a against the bias of the leaf spring 8 as the first pusher 12 slidingly engages the side cam surface 28 of the first stop 7. At the same time the two claws of the button A having been oriented are pushed by the first pusher 12 into the claw guide passageway 14 of the guide table 14. With continued forward movement of the first pusher 12, the button A is pushed thereby to the second stop 9 along the claw and button-head guide passageways 14, 15. During that time the second pusher 13 (which is disposed immediately upstream of the second stop 9) is moved toward the die 1 to cause the second stop 9 to be retracted from the longitudinal space 6*a* against the bias of the spring 10 as the second pusher 13 slidingly engages the side cam surface 30 of the second stop 9. At the same time a preceding button A is pushed by the second pusher 13 from the second stop 9 to the die 1.

Finally, the support bar 16 is returned to its original or retracted position in which the first and second pushers 12, 13 are disposed immediately upstream of the first and second stops 7, 9, respectively. During that time the first and second pushers 12, 13 pass under the first and second stops 7, 9, respectively, slidingly contacting the respective cam surfaces 26, 9*a*. Thus the first and second pushers 12, 13 are returned to their original or retracted positions without being obstructed by the first and second stops 7, 9.

With the apparatus thus constructed, partly because the claw guide passageway 14, 20 of each of the guide table 4 and the chute 11 has such a width as to prevent the claws of the individual button A from turning or rotating with respect to the respective claw guide passageway, and partly because the lower end portion 20*a* of the chute 11 is curved toward the die 1, the button A can be turned or rotated through a predetermined angle equal to the central angle subtended by the curved lower end portion 20*a*. Thus the button A can be oriented in a predetermined direction easily and accurately with a reduced number of parts.

Although various minor modifications ma be suggested by those versed in the art, it should be understood that I wish to embody within the scope of the patent wanted hereon, all such embodiments as reasonably and properly come within the scope of my contribution to the art.

What is claimed is:

1. An apparatus for placing a button on a die in a predetermined orientation for attachment to a garment, the button having a disk-like head and a pair of radially spaced claws projecting centrally from a rear surface of the head, said apparatus comprising:

(a) an elongate guide table defining a substantially horizontal first guide channel having one end adapted to be disposed continuous to the die for guiding the button therethrough onto the die, said first guide channel including a first claw guide passageway for guiding therethrough the two claws of the button so as to prevent the latter from turning with respect to said first claw guide passageway, and a first button-head guide passageway for guiding therethrough the head of the button;

(b) a chute defining a slanting second guide channel communicating at its lower end with the other end of said first guide channel for guiding the button therethrough into said first guide channel, said second guide channel including a second claw guide passageway for guiding therethrough the two claws of the button so as to prevent the latter from turning with respect to said second claw guide passageway for guiding therethrough the head of the button, said second claw guide passageway having an arcuate lower end portion curved toward said one end of said first guide channel, said chute having in its die-side wall at the lower end thereof a cut-out communicating with said first and second button-head guide passageways, a line tangential to a lower end of an arcuate end of said arcuate lower end portion of said second claw guide passageway being disposed at an angle of 45° to 65° with respect to said first claw guide passageway; and (c) a pusher mechanism mounted within said guide table below said first guide channel and reciprocable therealong for pushing the button through said first guide channel onto the die.

* * * * *